United States Patent [19]

Kato et al.

[11] Patent Number: 4,536,472

[45] Date of Patent: Aug. 20, 1985

[54] SILVER HALIDE COLOR PHOTOGRAPHIC LIGHT-SENSITIVE MATERIAL

[75] Inventors: Hirohiko Kato; Seiji Ichijima; Keiichi Adachi; Toshiyuki Watanabe, all of Kanagawa, Japan

[73] Assignee: Fuji Photo Film Co., Ltd., Kanagawa, Japan

[21] Appl. No.: 572,049

[22] Filed: Jan. 19, 1984

[30] Foreign Application Priority Data

Jan. 19, 1983 [JP] Japan ..... 58-7152

[51] Int. Cl.[3] ..... G03C 1/46

[52] U.S. Cl. ..... 430/505; 430/553; 430/555; 430/557; 430/558; 430/567; 430/568; 430/569

[58] Field of Search ..... 430/226, 553, 555, 557, 430/558, 505, 567, 568, 569

[56] References Cited

U.S. PATENT DOCUMENTS 4,301,235 11/1981 Ichijima et al. ..... 430/505
4,366,237 12/1982 Ichijima et al. ..... 430/554
4,407,936 10/1983 Ichijima et al. ..... 430/555
4,420,556 12/1983 Booms et al. ..... 430/555

OTHER PUBLICATIONS

Research Disclosure, Item 17643, pp. 22–23, Dec., 1978.

*Primary Examiner*—J. Travis Brown
*Attorney, Agent, or Firm*—Sughrue, Mion, Zinn, Macpeak & Seas

[57] ABSTRACT

A silver halide color photographic light-sensitive material comprising a support having thereon a blue-sensitive silver halide emulsion layer, a green-sensitive silver halide emulsion layer and a red-sensitive silver halide emulsion layer, at least one of these silver halide emulsion layers containing a non-diffusible coupler which forms a properly smearing diffusible dye upon reaction with the oxidation product of a color developing agent together with a monodispersed silver halide emulsion. The silver halide color photographic light-sensitive material provides color images having not only an improved RMS granularity but also an improved visual sensation of graininess.

14 Claims, 2 Drawing Figures

SILVER HALIDE COLOR PHOTOGRAPHIC LIGHT-SENSITIVE MATERIAL

FIELD OF THE INVENTION

The present invention relates to a silver halide color photographic light-sensitive material and more particularly to a silver halide color photographic light-sensitive material for photographing having improved graininess.

BACKGROUND OF THE INVENTION

Recently, there has been increasing popularity of small format cameras and the color photographic enlargement prints are often formed from a small-sized picture image of color negative films. Therefore, color photographic materials having further improved graininess and resolving power have been desired.

The graininess of a color image can be improved by increasing the number of silver halide grains and by making dyes formed by color development indefinite as described in T. H. James, *Theory of the Photographic Process,* 4th Ed., pages 620–621. However, the attempt at increasing the number of silver halide grains while maintaining a high photographic sensitivity requires an increase in the amount of coated silver and causes a reduction in resolving power. Thus this attempt is disadvantageous in view of cost and photographic properties.

The attempt at improving graininess by diffusion of dyes improves the RMS (root mean square) granularity by using so-called dye diffusible type couplers as described in British Patent No. 2,080,640A but this method gives an unpleasant visual sensation as described hereinafter.

The inventors have made various investigations with respect to improving graininess and have found the following. When a non-diffusible type coupler which forms a properly smearing diffusible dye (hereinafter, the non-diffusible type coupler is simply referred to as a dye diffusible type coupler) is employed, the so-called RMS granularity (the RMS granularity is described in T. H. James, *Theory of the Photographic Process,* 4th Ed., page 619) is greatly improved. However, the positioning and development probability of silver halide particles occur in random course, the dye diffuses to smear the mixes with the neighboring dye or dyes, whereby the overlap of dye clouds becomes larger, thus randomly forming huge dye clouds. This is visually very unpleasant and the visual sensation of graininess is sometimes deteriorated.

SUMMARY OF THE INVENTION

Therefore, an object of the present invention is to provide a silver halide color photographic light-sensitive material having both improved RMS granularity and improved visual sensation of graininess.

Other objects of the present invention will be apparent from the following detailed description and examples.

As the results of various investigations on improving the visual sensation of graininess, it has now been found that by using a dye diffusible type coupler together with a monodispersed silver halide emulsion, the foregoing unpleasant visual sensation is eliminated and a color photographic material having excellent visual graininess and RMS granularity can be provided.

That is, according to the present invention, there is provided a silver halide color photographic light-sensitive material comprising a support having provided thereon a blue-sensitive silver halide emulsion layer, a green-sensitive silver halide emulsion layer, and a red-sensitive silver halide emulsion layer, at least one of these silver halide emulsion layers containing a non-diffusible coupler which forms a properly smearing diffusible dye upon reaction with the oxidation product of a color-developing agent together with a monodispersed silver halide emulsion.

DETAILED DESCRIPTION OF THE INVENTION

Figure 1:
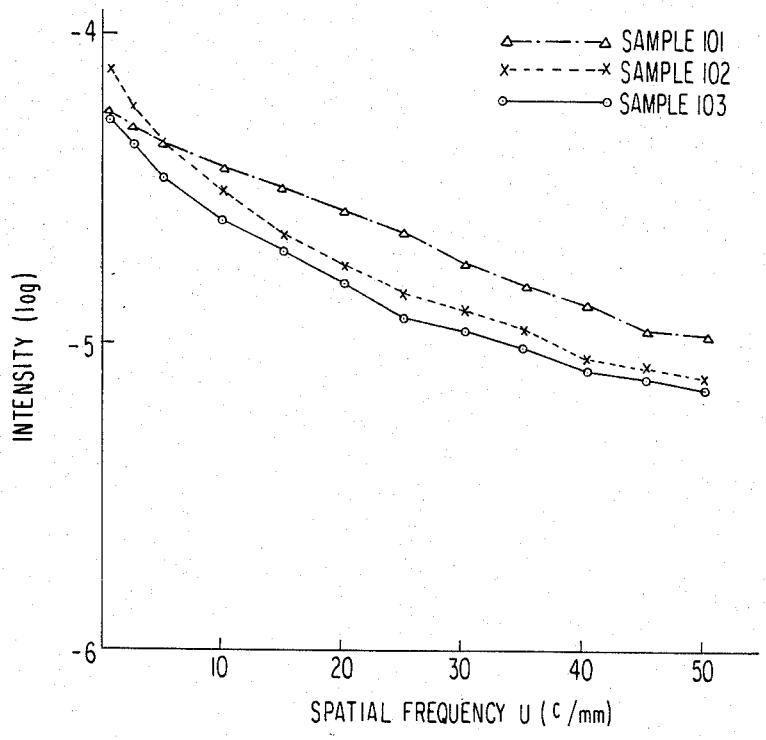
FIG. 1 is a graph showing the Wiener spectra of magenta images of samples 101, 102, and 103.

When a dye diffusible type coupler is used, equal amounts of dyes diffuse into the periphery of each dye cloud creating a dye cloud having a small distribution of density and a large area (hereinafter referred to as a diffusion type dye cloud). The granularity of an image obtained using such a dye is expressed by the so-called RMS value, and an improved value is obtained. However, since the dye clouds become larger as described above, the dye clouds overlap each other. Therefore, when the granularity is expressed by the so-called Wiener spectrum (see, T. H. James, *The Theory of Photographic Process,* 4th Ed., page 621), the value of expressing the granularity at a low frequency portion thereof becomes somewhat higher when using the dye diffusible type coupler (the lower the value, the better the granularity). For example, in FIG. 1, at the portion where spatial frequency U is less than 5, the curve for Sample 102 is disposed above the curve for Sample 101. This means that in visual sensation large mottles composed of several dye clouds are seen. Actually, the use of a dye diffusible type coupler gives a very unpleasant visual sensation and gives the appearance that the graininess is bad whereas the value of the granularity expressed by the RMS value becomes better.

When a monodispersed silver halide emulsion is employed in such a system, the foregoing diffusible type dye clouds become smaller while keeping the same shape. This results in reducing the overlap of the dye clouds with each other to reduce the value of the Wiener spectrum at the low frequency portion. In other words, by the utilization of the monodispersed silver halide emulsion, large mottles are not visualized, whereby the visual sensation of graininess is improved.

As described above, in the present invention the visual graininess of a silver halide color photographic light-sensitive material is greatly improved by using the dye diffusible type coupler and the monodispersed silver halide emulsion.

The dye diffusible type couplers used in the present invention include compounds represented by the following general formula (1);

$$(C_p—X_a \qquad (1)$$

wherein Cp represents a diffusible coupler moiety which improves the granularity by causing proper smearing of the dye image; X represents a group which is bonded to the coupling position of the coupler moiety and is released by the reaction with the oxidation product of a color developing agent, the group being a moiety including a ballast group having from 8 to 32 carbon atoms; and a represents 1 or 2.

The amount of the dye diffusible type coupler to be added is from 0.005 mole to 0.2 mole, preferably from 0.01 mole to 0.05 mole, per mole of silver.

Of the couplers represented by the general formula (1), couplers represented by the following general formulae (I) and (II) are preferred.

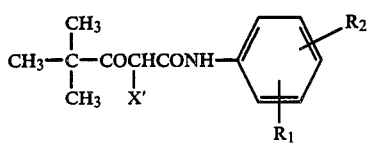

(I)

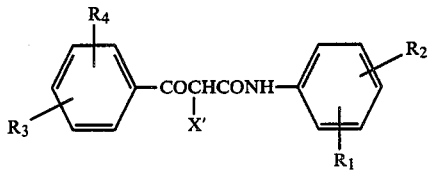

(II)

wherein $R_1$, $R_2$, $R_3$, and $R_4$, which may be the same or different, each represents a hydrogen atom, a halogen atom, an alkyl group (e.g., a methyl group, and ethyl group, an isopropyl group, a hydroxyethyl group, etc.), an alkoxy group (e.g., a methoxy group, an ethoxy group, a methoxyethoxy group, etc.), an aryloxy group (e.g., a phenoxy group, etc.), an acylamino group (e.g., an acetylamino group, a trifluoroacetylamino group, etc.), a sulfonamino group (e.g., a methanesulfonamino group, a benzenesulfonamino group, etc.), a carbamoyl group, a sulfamoyl group, an alkylthio group, an alkylsulfonyl group, an alkoxycarbonyl group, a ureido group, a cyano group, a carboxy group, a hydroxy group or a sulfo group, the total number of the carbon atoms included in $R_1$, $R_2$, $R_3$ and $R_4$ not exceeding 10; and X' represents a group which has a so-called ballast group having from 8 to 32 carbon atoms rendering the coupler non-diffusible and can be released by coupling with the oxidation product of an aromatic primary amine color developing agent. More specifically, X' can be represented by the following general formula (III) or (IV):

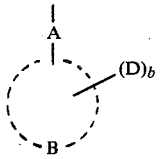

(III)

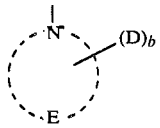

(IV)

wherein A represents an oxygen atom or a sulfur atom; B represents a non-metallic atomic group necessary for forming an aryl ring or a heterocyclic ring; E represents a non-metallic atomic group necessary for forming a 5-membered or 6-membered heterocyclic ring together with the nitrogen atom, provided that each of these rings may be further fused with an aryl ring or a heterocyclic ring; D represents a ballast group; and b represents a positive integer, provided that when b is the plural number, Ds' may be the same or different and the total number of the carbon atoms included therein is from 8 to 32, and further that D may have a bonding group such as —O—, —S—, —COO—, —CONH—, —$SO_2$NH—, —NHCONH—, —$SO_2$—, —CO—, —NH—, etc.

Other preferred examples of the couplers represented by general formula (I) are couplers represented by the following general formulae (V), (VI) and (VII):

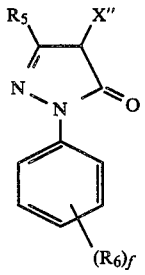

(V)

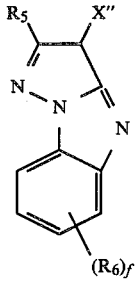

(VI)

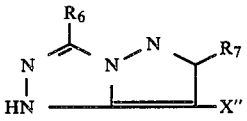

(VII)

wherein $R_5$ represents an acylamino group (e.g., a propanamido group, a benzamido group, etc.), an anilino group (e.g., a 2-chloroanilino group, a 5-acetamidoanilino group, etc.), or a ureido group (e.g., a phenylureido group, a butaneureido group, etc.); $R_6$ and $R_7$ each represents a halogen atom, an alkyl group (e.g., a methyl group, an ethyl group, etc.), an alkoxy group (e.g., a methoxy group, an ethoxy group, etc.), an acylamino group (e.g., an acetamido group, a benzamido group, etc.), an alkoxycarbonyl group (e.g., a methoxycarbonyl group, etc.), an N-alkylcarbamoyl group (e.g., an N-methylcarbamoyl group, etc.), a ureido group (e.g., an N-methylureido group, etc.), a cyano group, an aryl group (e.g., a phenyl group, a naphthyl group, etc.), an N,N-dialkylsulfamoyl group, a nitro group, a hydroxy group, a carboxy group, or an aryloxy group; f is 0 or an integer of 1 to 4, provided that when f is 2 to 4, $R_6$s' may be the same of different, and further that the total number of the carbon atoms included in $R_5$ and $(R_6)_f$ in the general formula (V) or (VI) and the total number of the carbon atoms included in $R_6$ and $R_7$ in the general formula (VII) should not exceed 10; and X'' represents a group represented by the following general formula (VIII), (IX) or (X):

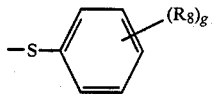

(VIII)

$-S-R_8$ (IX)

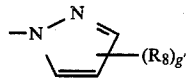

(X)

wherein g is an integer of 1 to 5; g' is an integer of 1 to 3; and $R_8$ represents a substituted or unsubstituted alkyl group (e.g., a butyl group, a dodecyl group, etc.), a substituted or unsubstituted aralkyl group (e.g., a benzyl group, etc.), a substituted or unsubstituted alkenyl group (e.g., an allyl group, etc.), or a substituted or unsubstituted cyclic alkyl group (e.g., a cyclopentyl group, etc.), the substituents for the foregoing groups including a halogen atom, an alkoxy group (e.g., a butoxy group, a dodecyloxy group, etc.), an acylamino group (e.g., an acetamido group, a tetradecanamido group, etc.) an alkoxycarbonyl group (e.g., a tetradecyloxycarbonyl group, etc.), an N-alkylcarbamoyl group (e.g., an N-dodecylcarbamoyl group, etc.), a ureido group (e.g., a tetradecylureido group, etc.), a cyano group, an aryl group (e.g., a phenyl group, etc.), a nitro group, an alkylthio group (e.g., a dodecylthio group, etc.), an alkylsulfinyl group (e.g., a tetradecylsulfinyl group, etc.), an alkylsulfone group, an anilino group, a sulfonamido group (e.g., a hexadecanesulfonamido group, etc.), an N-alkylsulfamoyl group, an aryloxy group, or an acyl group (e.g., a tetradecanoyl group, etc.), provided when g or g' is 2 or more, $R_8$'s may be the same of different and the total number of the carbon atoms included in $(R_8)_{g'}$ of the formula (X) is from 8 to 32.

Still other preferred examples of the couplers represented by the general formula (I) are couplers represented by the following general formulae (XI) and (XII):

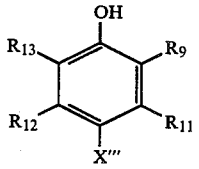

(XI)

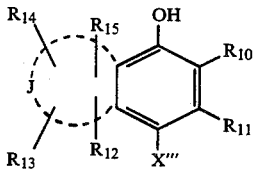

(XIII)

wherein $R_9$ represents a hydrogen atom, an aliphatic group having up to 10 carbon atoms (e.g., an alkyl group such as a methyl group, an isopropyl group, an amyl group, a cyclohexyl group, an octyl group, etc.), an alkoxy group having up to 10 carbon atoms (e.g., a methoxy group, an isopropoxy group, a pentadecyloxy group, etc.), an aryloxy group (e.g., a phenoxy group, a p-tert-butylphenoxy group, etc.), an acylamido group represented by the following general formula (XIII), a sulfonamido group represented by the following general formula (XIV), a ureido group represented by the following general formula (XV), or a carbamoyl group represented by the following general formula (XVI):

$-NH-CO-G$ (XIII)

$-NH-SO_2-G$ (XIV)

$-NHCONH-G$ (XV)

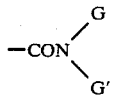

(XVI)

wherein G and G', which may be the same or different and in which the total number of the carbon atoms included in G and G' is from 1 to 12 in the formula (XVI), each represents a hydrogen atom (excluding the case that both G and G' in the formula (XVI) are hydrogen atoms); an aliphatic group having from 1 to 12 carbon atoms, preferably a straight chain or branched chain alkyl group having from 4 to 10 carbon atoms or a cyclic alkyl group (e.g., a cyclopropyl group, a cyclohexyl group, a norbornyl group, etc.); or an aryl group (e.g., a phenyl group, a naphthyl group, etc.). The foregoing alkyl group and aryl group may be substituted with a halogen atom (e.g., a fluorine atom, a chlorine atom, etc.), a nitro group, a cyano group, a hydroxy group, a carboxy group, an amino group (e.g., an amino group, an alkylamino group, a dialkylamino group, an anilino group, an N-alkylanilino group, etc.), an alkyl group (e.g., the alkyl group as described above), an aryl group (e.g., a phenyl group, an acetylamino phenyl group, etc.), an alkoxycarbonyl group (e.g., a butyloxycarbonyl group, etc.), an acyloxycarbonyl group, an amido group (e.g., an acetamido group, a methanesulfonamido group, etc.), an imido group (e.g., a succinimido group, etc.), a carbamoyl group (e.g., an N,N-diethylcarbamoyl group, etc.), a sulfamoyl group (e.g., an N,N-diethylsulfamoyl group, etc.), an alkoxy group (e.g., an ethoxy group, a butyloxy group, an octyloxy group, etc.), an aryloxy group (e.g., a phenoxy group, a methylphenoxy group, etc.), etc. $R_9$ may also has an ordinary substituent in addition to the foregoing substituent.

$R_{10}$ represents a hydrogen atom or an aliphatic group having up to 12 carbon atoms, in particular an alkyl group having from 1 to 10 carbon atoms, or the carbamoyl group represented by the foregoing general formula (XVI).

$R_{11}$, $R_{12}$, $R_{13}$, $R_{14}$ and $R_{15}$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group, or a carbamoyl group. More specifically, $R_{11}$, $R_{12}$, $R_{13}$, $R_{14}$ and $R_{15}$ each represents a hydrogen atom, a halogen atom (e.g., a chlorine atom, a bromine atom, etc.), a primary, secondary or tertiary alkyl group having from 1 to 12 carbon atoms (e.g., a methyl group, a propyl group, an isopropyl group, an n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)ethyl group, a 2-aminoethyl group, etc.), an alkylthio group (e.g., an octylthio group, etc.), an aryl group (e.g., a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, etc.), a heterocyclic group (e.g., a benzofuranyl group, a furyl group, a thiazolyl group, a benzothiazolyl group, a naphthothiazolyl group, an oxazolyl group, a benzoxazolyl group, a naphthoxazolyl group, a pyridyl group, a quinolyl group, etc.), an amino group (e.g., an amino group, a methylamino group, a diethylamino group, a dodecylamino group, a phenylamino group, a tolylamino group, a 4-cyanophenylamino group, a 2-trifluoromethylphenylamino group, a benzothiazolylamino group, etc.), a carbonamido group (e.g., an alkylcarbonamido group such as an ethylcarbonamido group, a decylcarbonamideo group, etc.; an arylcarbonamido group such as a phenylcarbonamido group, a 2,4,6-trichlorophenylcarbonamido group, a 4-methylphenylcarbonamido group, a 2-ethoxyphenylcarbonamido group, a naphthylcarbonamido group, etc.; a heterocyclic carbonamido group such as a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.), a sulfonamido group (e.g., an alkylsulfonamido group such as a butylsulfonamido group, a dodecylsulfonamido group, a phenylethylsulfonamido group, etc.; an arylsulfonamido group such as a phenylsulfonamido group, a 2,4,6-trichlorophenylsulfonamido group, a 2-methoxyphenylsulfonamido group, a 3-carboxyphenylsulfonamido group, a naphthylsulfonamido group, etc.; a heterocyclic sulfonamido group such as a thiazolylsulfonamido group, a benzothiazolylsulfonamido group, an imidazolylsulfonamido group, a benzimidazolylsulfonamido group, a pyridylsulfonamido group, etc.), a sulfamoyl group (e.g., an alkylsulfamoyl group such as a propylsulfamoyl group, an octylsulfamoyl group, etc.; an arylsulfamoyl group such as a phenylsulfamoyl group, a 2,4,6-trichlorophenylsulfamoyl group, a 2-methoxy phenylsulfamoyl group, a naphthylsulfamoyl group, etc.; a heterocyclic sulfamoyl group such as a thiazolylsulfamoyl group, a benzothiazolylsulfamoyl group, an oxazolylsulfamoyl group, a benzimidazolylsulfamoyl group, a pyridylsulfamoyl group, etc.), or a carbamoyl group (e.g., an alkylcarbamoyl group such as an ethylcarbamoyl group, an octylcarbamoyl group, etc.; an arylcarbamoyl group such as a phenylcarbamoyl group, a 2,4,6-trichlorophenylcarbamoyl group, etc.; a heterocyclic carbamoyl group such as a thiazolylcarbamoyl group, a benzothiazolylcarbamoyl group, an oxazolylcarbamoyl group, an imidazolylcarbamoyl group, a benzimidazolylcarbamoyl group, etc.).

J represents a non-metallic atomic group necessary for forming a 5-membered or 6-membered ring such as a benzene ring, a cyclohexene ring, a cyclopentene ring, a thiazole ring, an oxazole ring, an imidazole ring, a pyridine ring, a pyrrole ring, etc. Of these rings a benzene ring is preferred.

X''' represents a group which has from 8 to 32 carbon atoms, is bonded to the coupling position through —O—, —S—, or —N=N—, and is released upon coupling with the oxidation product of an aromatic primary amine color developing agent. Preferably, X''' represents an alkoxy group, an aryloxy group, an alkylthio group, or an arylthio group, each group having from 8 to 32 carbon atoms. These groups may further contain a divalent group such as —O—, —S—, —NH—, —CONH—, —COO—, —$SO_2$NH—, —SO—, —$SO_2$—, —CO—,

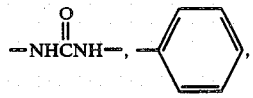

etc. It is particularly preferred that these groups have a group capable of being dissociated with an alkali, such as —COOH, —$SO_3$H, —OH, —$SO_2NH_2$, etc. Moreover, it is possible to render the coupler substantially non-diffusible by combining $R_9$, $R_{10}$, $R_{11}$, $R_{12}$, $R_{13}$, $R_{14}$, $R_{15}$, and X'''.

Specific examples of the dye diffusible type couplers are shown below, but the present invention should not be construed as being limited thereto.

Y-1

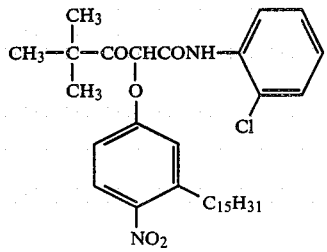

Y-2

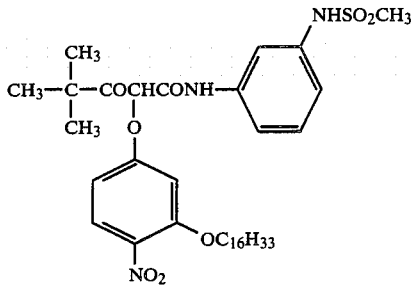

Y-3

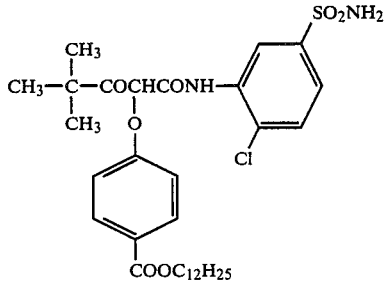

Y-4

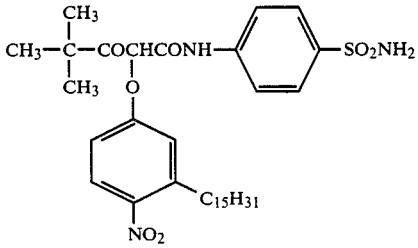

-continued
Y-5
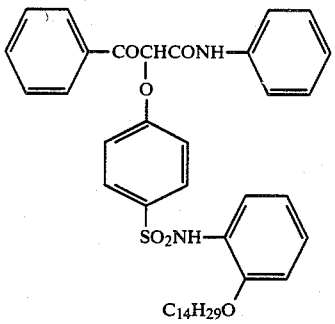
Y-6
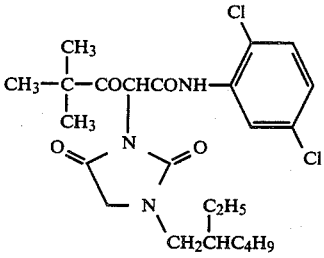
Y-7
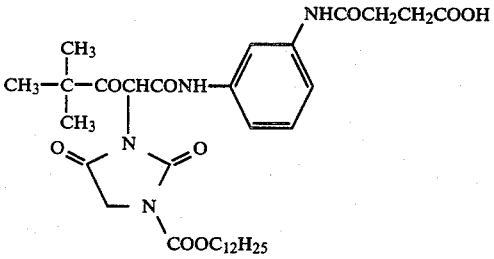
Y-8
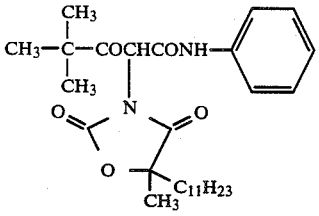
Y-9
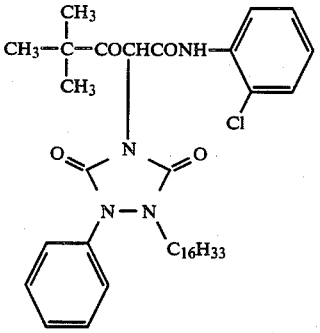
Y-10
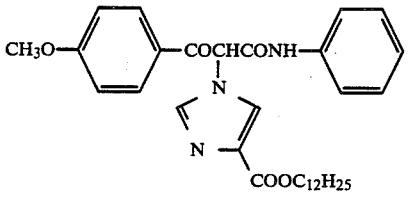
-continued
Y-11
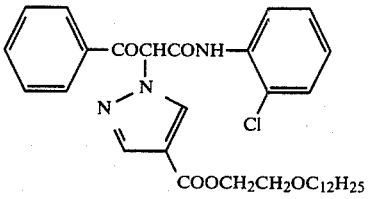
Y-12
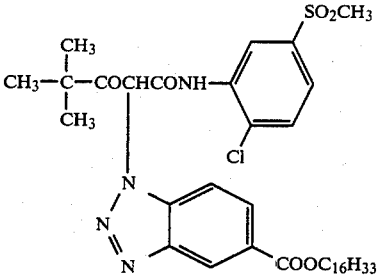
Y-13
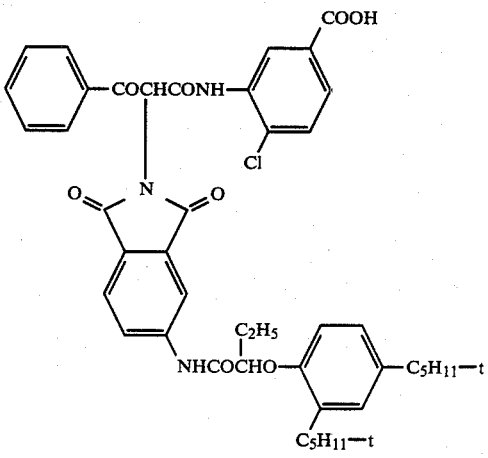
Y-14
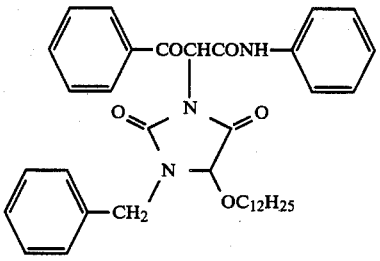
Y-15
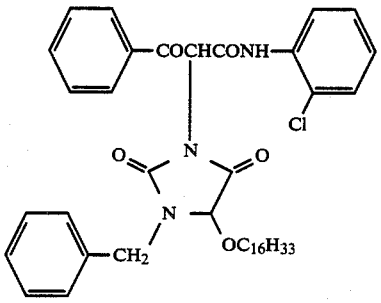

-continued
M-1
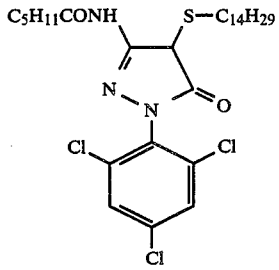
M-2
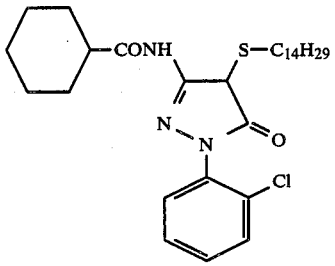
M-3
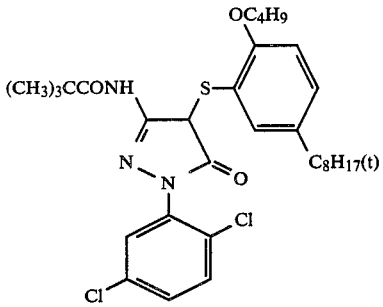
M-4
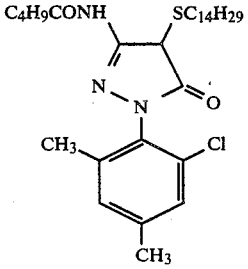
M-5
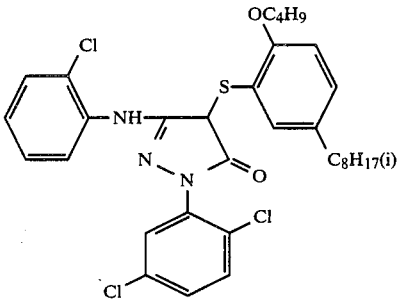
-continued
M-6
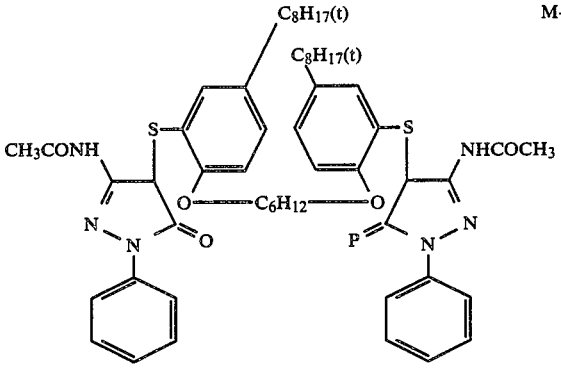
M-7
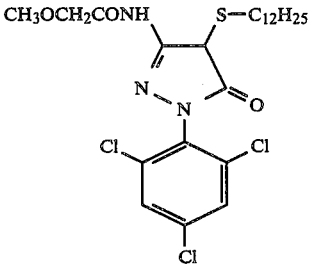
M-8
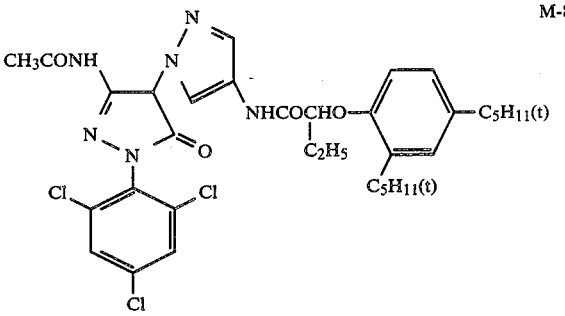
M-9
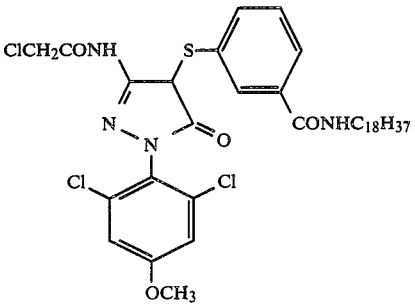
M-10
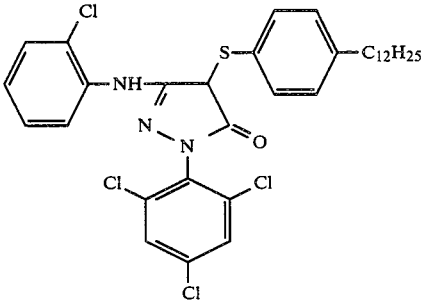

-continued
M-11
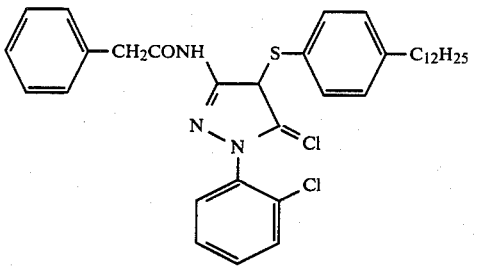
M-12
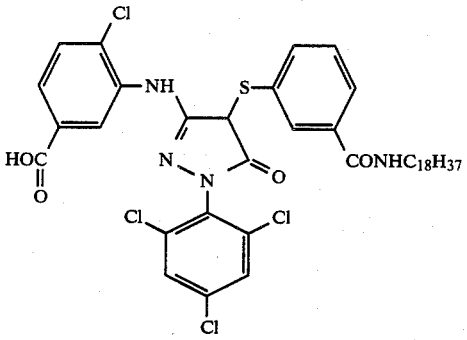
M-13
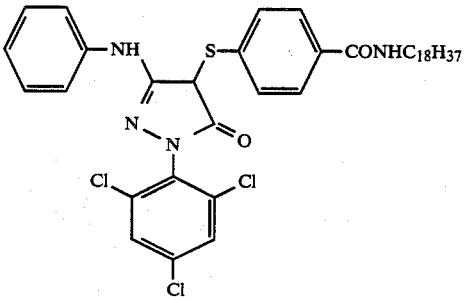
M-14
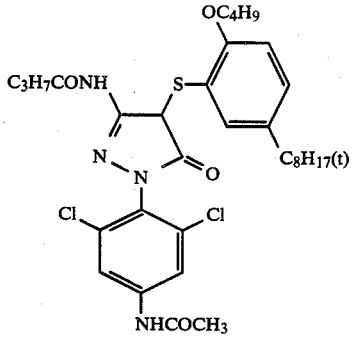
M-15
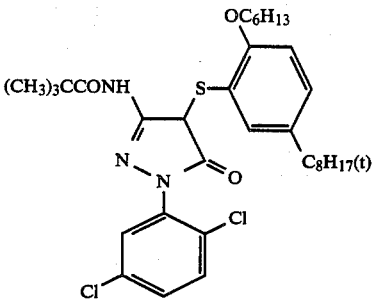
The foregoing compounds used in the present invention can be prepared by the methods as described in, for example, U.S. Pat. Nos. 4,264,723, 3,227,554, 4,310,619 and 4,301,235, Japanese Patent Application (OPI) Nos. 4044/82, 126833/81 and 122935/75, etc. (OPI herein used means an unexamined published Japanese patent application).
C-1
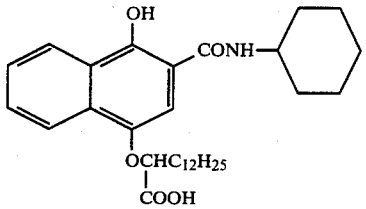
C-2
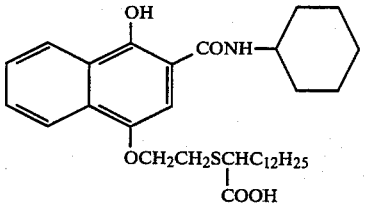
C-3
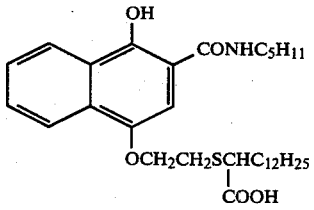
C-4
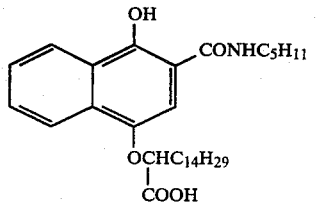
C-5
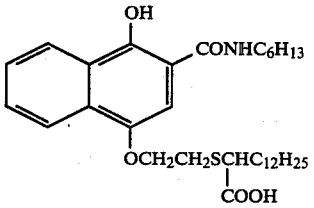
C-6
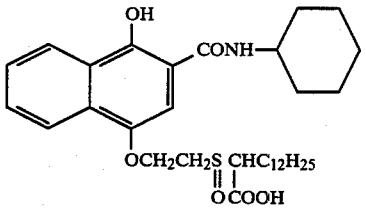
C-7
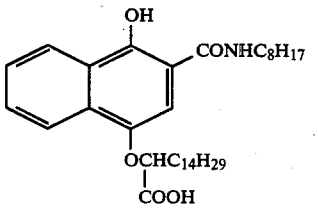

-continued

C-8

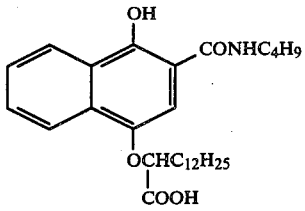

C-9

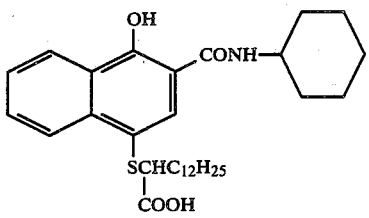

C-10

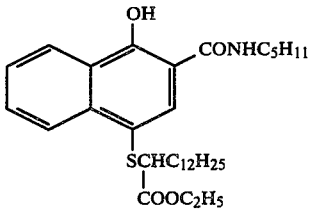

C-11

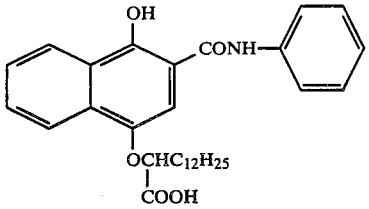

C-12

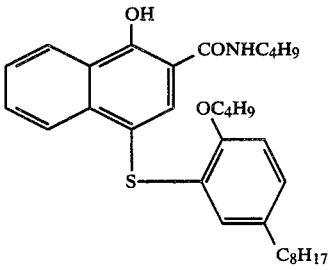

C-13

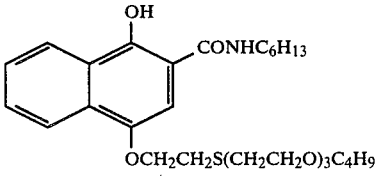

C-14

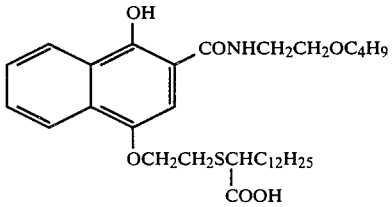

-continued

C-15

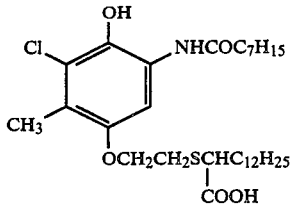

C-16

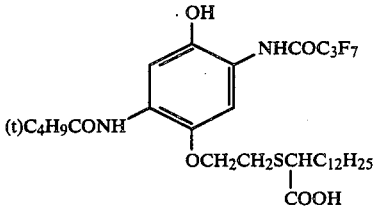

C-17

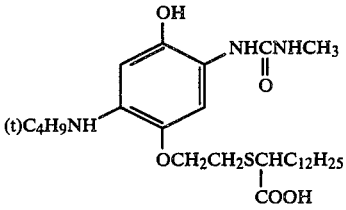

C-18

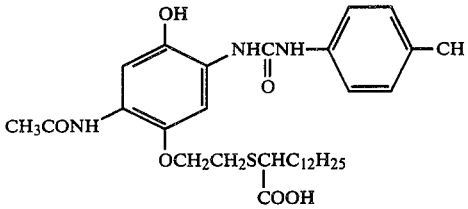

C-19

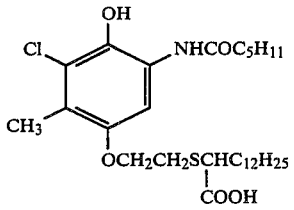

The foregoing compounds used in the present invention can be easily prepared by the methods as described in Japanese Patent Application (OPI) Nos. 1938/81, 3934/82 and 105226/78, etc.

The term "monodispersed silver halide emulsion" referred to in the present invention means a silver halide emulsion comprising at least 90% of the total silver halide grains having a size within the range from 0.6 to 1.4 times the mean grain size which is determined by the weight or number distribution of the total silver halide grains obtained from the difference in the electric conductivity measured when passed through an aperture.

The average grain size of the monodispersed emulsion used in the present invention is in the range from 0.1 micron to 3 microns and preferably from 0.4 micron to 2 microns.

With respect to the composition of the silver halide, any of silver bromide, silver chloride, silver chlorobromide, silver iodobromide, and silver chloroiodobromide can be used. Silver iodobromide containing 2% by mole or more of silver iodide is particularly preferred in view of the effects obtained.

The monodispersed emulsion used in the present invention can be prepared by the method as described in U.S. Pat. No. 3,574,628 (incorporated herein by reference to disclose such a method), the method as described in British Pat. No. 1,520,976, the so-called controlled double jet method in which silver halide grains are prepared by simultaneously mixing silver nitrate and alkali halides while maintaining the pAg in the reaction solution at a constant value, and the method in which silver halide grains are subjected to growth under the diffusion rate-determining conditions using ammonia as described in Japanese Patent Application (OPI) No. 142329/70.

Gelatin is advantageously employed as a binder or a protective colloid for the silver halide photographic emulsion in the present invention but other hydrophilic colloids can also be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharide derivatives such as sodium alginate, starch derivatives, etc.; and various synthetic hydrophilic polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

Gelatin used in the present invention includes lime-treated gelatin, acid-treated gelatin, and the enzyme-treated gelatin as described in *Bull. Soc. Sci. Phot. Japan*, No. 16, page 30 (1966). Further, hydrolyzed products or enzyme-decomposed products of gelatin can also be used.

The formation of the silver halide grains or the physical ripening thereof may be performed in the presence of a cadmium salt, a zinc salt, a lead salt, a thallium salt, an iridium salt, or the complex salts thereof, a rhodium salt or the complex salts thereof, or an iron salt or the complex salts.

The silver halide photographic emulsion layers or other hydrophilic colloid layers of the photographic materials of the present invention may contain various surface active agents for the purposes of improving coating properties, static prevention, slipping property, emulsified dispersion, adhesion prevention, and photographic properties (e.g., development acceleration, contrast increasing, sensitization, etc.)

Examples of such surface active agents are nonionic surface active agents such as saponin (steroid series), alkylene oxide derivatives (e.g., polyethylene glycol, a polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, etc.; anionic surface active agents having an acid group such as a carboxy group, a sulfo group, a phospho group, a sulfuric acid ester group, a phosphoric acid ester group, etc., such as alkyl carboxylates, alkyl sulfonates, alkyl benzenesulfonates, alkyl naphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkyl phosphoric acid esters, etc; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts (e.g., pyridinium, imidazolium, etc.), phosphonium salts or sulfonium salts containing an aliphatic or heterocyclic ring.

The silver halide photographic emulsion layers of the photographic materials of the present invention may contain polyalkylene oxides or the derivatives thereof such as the ethers, esters, amines, etc., thioether compounds, thiomorpholines, quaternary ammonium salts, urethane derivatives, urea derivatives, imidazole derivatives, 3-pyrazolidones, etc., for the purposes of sensitivity increase, contrast increase, or development acceleration. Practical examples of such additives are described in, for example, U.S. Pat. Nos. 2,400,532, 2,423,549, 2,716,062, 3,617,280, 3,772,021 and 3,808,003, British Pat. No. 1,488,991, etc.

The silver halide photographic light-sensitive materials of the present invention may further contain a dispersion of a water-insoluble or water sparingly soluble synthetic polymer for improving the dimensional stability of the photographic materials. As such synthetic polymers, there are polymers of monomers such as alkyl(meth)acrylates, alkoxyalkyl(meth)acrylates, glycidyl(meth)acrylate, (meth)acrylamide, vinyl esters (e.g., vinyl acetate), acrylonitrile, olefins, styrene, etc., individually or as a combination of them or polymers of these monomers and acrylic acid, methacrylic acid, $\alpha$, $\beta$-unsaturated dicarboxylic acids, hydroxyalkyl(meth)acrylates, sulfoalkyl(meth)acrylates, styrenesulfonic acid, etc.

For photographic processing of the photographic light-sensitive materials of the present invention, any known processes and known processing solutions as described, for example, in *Research Disclosure*, No. 176, pages 28–30 (RD-17643) can be employed. The photographic processing may be a photographic process for forming silver image (black ad white processing) or a photographic process for forming dye image (color photographic processing). The processing temperature is usually selected in a range from 18° C. to 50° C. but may be lower than 18° C. of higher than 50° C.

As a fixing solution, an ordinary fixing composition can be used. As the fixing agent, a thiosulfate, a thiocyanate, or an organic sulfur compound which is known to have an effect as a fixing agent can be used. The fixing solution may contain a water-soluble aluminum salt as a hardening agent.

For forming dye images, an ordinary process can be employed. For example, there are a nega-posi process as described in, for example, *Journal of the Society of Motion Picture and Television Engineers*, Vol. 61, pages 667–701 (1953), a color reversal process of obtaining a positive dye image by developing the photographic material by a developer containing a black and white developing agent to form a negative silver image, applying thereto at least one uniform light exposure or other proper fogging treatment, and then performing a color development.

A color developing solution used in the present invention is generally composed of an aqueous alkaline solution containing a color developing agent. As the color developing agent used in the present invention, known primary aromatic amine developing agents including phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.) can be used.

Other examples of the color developing agents used in the present invention are described in, for example, L. F. A. Mason, *Photographic Processing Chemistry*, pages 226–229 (1966), published by Focal Press Co., U.S. Pat. Nos. 2,193,015 and 2,592,364, Japanese Patent Application (OPI) No. 64933/73, etc.

The color developing solution used in the present invention may further contain a pH buffer, a development inhibitor, or an antifoggant. Also, the color developing solution may further contain, if desired, a water softener, a preservative, an organic solvent, a development accelerator, a dye-forming coupler, a fogging agent, an auxiliary developing agent, a viscosity imparting agent, a polycarboxylic acid series chelating agent, an antioxidant, etc.

Practical examples of these additives are described in, for example, *Research Disclosure* (RD-17643) and U.S. Pat. No. 4,083,723; West Germany Offenlegungsschrift No. 2,622,950, etc.

The silver halide photographic emulsion layers are usually bleached after color development. The bleaching process may be performed either simultaneously with or separately from a fixing process. Useful bleaching agents include compounds or a multivalent metal such as iron (III), cobalt (III), chromium (VI), copper (II), etc., peracids, quinones, nitroso compounds, etc.

Examples of the bleaching agents are ferricyanides; dichromates; organic complex salts of iron (III) or cobalt (III), for example, the complex salts of aminopolycarboxylic acids such as ethylenediamine tetraacetic acid, nitrilo triacetic acid, 1,3-diamino-2-propanol tetraacetic acid, etc., or organic acids such as citric acid, tartaric acid, malic acid, etc.; persulfates; permanganates; nitrosophenol, etc. Of these materials potassium ferricyanide, sodium iron (III) ethylenediamine tetraacetate and ammonium iron (III) ethylenediamine tetraacetate are particularly useful. The ethylenediamine tetraacetic acid iron (III) complex salt can be profitably used for a bleaching solution or a monobath blixing solution.

The bleaching solution of blixing solution may further contain the bleach accelerator as described in, for example, U.S. Pat. Nos. 3,042,520 and 3,241,966, Japanese Patent Publication Nos. 8506/70 and 8836/70, the thiol compound as described in Japanese Patent Application (OPI) No. 65732/78, and other various additives.

The silver halide photographic emulsions used in the present invention may be spectrally sensitized by methine dyes, etc.

Useful sensitizing dyes are described in, for example, German Patent 929,080, U.S. Pat. Nos. 2,493,748, 2,503,776, 2,519,001, 2,912,329, 3,656,959, 3,672,897 and 4,025,349, British Pat. No. 1,242,588 and Japanese Patent Publication No. 14030/69.

These sensitizing dyes may be used individually or as a combination of them and a combination of sensitizing dyes is frequently used for super sensitization. Typical examples of such combinations are described, for example, in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, and Japanese Patent Application (OPI) Nos. 110618/77 and 109925/77.

The present invention can be applied to a multilayered multicolor photographic material having at least two differently sensitized photographic emulsion layers on a support. A multilayered natural color photographic material usually has at least one red-sensitive silver halide emulsion layer, at least one green-sensitive silver halide emulsion layer, and at least one blue-sensitive silver halide emulsion layer on a support. The order of these emulsion layers can be desirably selected according to the necessity. Usually, a red-sensitive emulsion layer contains a cyan-forming coupler, a green-sensitive emulsion layer contains a magenta-forming coupler, and a blue-sensitive emulsion layer contains a yellow-forming coupler but as the case may be, other combinations are employed.

The photographic materials of the present invention may contain an inorganic or organic hardening agent. Examples of such hardening agents as chromium salts (e.g., chromium alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., and they may be used solely or as a combination of them.

These photographic materials of the present invention may further contain ultraviolet absorbents in the hydrophilic colloid layers. Examples of ultraviolet absorbents used in the present invention are a benzotriazole compound substituted with an aryl group, a 4-thiazolidone compound, a benzophenone compound, a cinnamic acid compound, a butadiene compound, a benzoxazole compound, and ultraviolet absorptive polymers. These ultraviolet absorbents may be fixed in the foregoing hydrophilic colloid layers.

Practical examples of the ultraviolet absorbents are described in, for example, U.S. Pat. Nos. 3,533,794, 3,314,794, and 3,352,681, Japanese Patent Application (OPI) No. 2784/71, U.S. Pat. Nos. 3,705,805, 3,707,375, 4,045,229, 3,700,455 and 3,499,762, West German Patent Publication (DAS) No. 1,547,863, etc.

The photographic materials of the present invention may further contain water-soluble dyes as filter dyes or for other various purposes such as irradiation prevention, etc. Examples of such dyes are oxonol dyes, hemioxonol dyes, styryl dyes, merocyanine dyes, cyanine dyes, and azo dyes. Of these dyes, oxonol dyes, hemioxonol dyes, and merocyanine dyes are particularly useful.

Practical examples of the water-soluble dyes are described, for example, in British Pat. Nos. 546,708, 584,609, 1,265,842 and 1,410,488, U.S. Pat. Nos. 2,274,782, 2,286,714, 2,526,632, 2,606,833, 2,956,879, 3,148,187, 3,247,127, 3,481,927, 3,575,704, 3,653,905 and 3,718,472, etc.

The silver halide photographic emulsion layers of the photographic materials of the present invention may further contain known color-forming couplers, i.e., compounds capable of color forming by the oxidative coupling with an aromatic primary amine developing agent (e.g., a phenylenediamine derivative, an amino-phenol derivative, etc.) in color development in addition to the dye diffusible type couplers. Examples of these color-forming couplers used in the present invention are such magenta couplers as 5-pyrazolone couplers, pyrazolobenzimidazole couplers, cyanoacetylcumarone couplers, open chain acylacetonitrile couplers, etc.; such yellow couplers as acylacetamido couplers (e.g., benzoylacetanilides, pivaloylacetanilides, etc.), etc.; and such cyan couplers as phenol couplers, naphthol couplers, etc. It is desirable that these couplers are not-diffusible couplers having a hydrophobic group called as ballast group in each of the molecules. These couplers may be 4-equivalent couplers or two-equivalent couplers with respect to silver ions. Also, these couplers may be colored couplers having a color correction effect or couplers releasing a development inhibitor with the progress of development (so-called DIR couplers). Furthermore, the silver halide photographic emulsions may contain non-color-forming DIR coupling compounds which form a colorless coupling reaction product and release a development inhibitor.

For incorporating couplers in the silver halide emulsion layers in the present invention, a known method such as the method described in, for example, U.S. Pat. No. 2,332,027 can be used. For example, the coupler is dissolved in an organic solvent having a high-boiling point such as a phthalic acid alkyl ester (e.g. dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azelate, etc.), a trimesic acid ester (e.g., tributyl trimesate, etc.), etc., or an organic solvent having a boiling point of about 30° C. to 150° C., such as a lower alkyl acetate (e.g., ethyl acetate, butyl acetate, etc.), secondary butyl alcohol, methyl isobutyl ketone, β-ethoxyethyl acetate, methyl cellosolve acetate, etc., and then the solution is dispersed in a hydrophilic colloid. A mixture of the foregoing organic solvent having a high-boiling point and an organic solvent having a low-boiling point may be used in the aforesaid method.

Also, the dispersing method using a polymer as described in Japanese Patent Publication No. 39853/76, Japanese Patent Application (OPI) No. 59943/76, etc. can be used.

When the coupler has an acid group such as a carboxylic acid group or a sulfonic acid group, the coupler is added to a hydrophilic colloid as an alkaline aqueous solution of the coupler.

In the embodiments of the present invention the effect of the present invention is particularly large when the invention is applied to a high-sensitive silver halide emulsion layer.

The invention is particularly preferred when the invention is combined with a DIR coupler wherein the diffusibility of the releasing group thereof is particularly large or a DIR coupler having a timing controlling group as described in Japanese Patent Application (OPI) No. 145135/79 and British Pat. No. 2,072,363, etc.

The present invention will further be explained more specifically with reference to the following examples. However, the scope of the invention is not limited to these examples.

EXAMPLE 1

Monodispersed Emulsion A was prepared in the following procedure.

One liter of an aqueous gelatin solution containing 0.01 mol of potassium bromide and 1.4 mols of ammonia was put into a reaction vessel and to the solution were simultaneously added 500 ml of an aqueous solution containing 0.27 mol of silver nitrate and 500 ml of an aqueous solution containing 0.24 mol of potassium bromide and 0.043 mol of potassium iodide over a period of 30 minutes while controlling the amount of additives in order to maintain a 0.2 g/l excess of the halogen ion with respect to the silver ion. After neutralizing the ammonia using an acid, to the mixture were simultaneously added 500 ml of an aqueous solution containing 0.62 mol of silver nitrate and 500 ml of an aqueous solution containing 0.71 mol of potassium bromide and 0.01 mol of potassium iodide over a period of 30 minutes while controlling the amount of additives in order to maintain a 0.2 g/l excess of the halogen ion with respect to the silver ion. The emulsion thus-prepared had size distribution in which 92% of the total grains present were within the range of ±40% of the mean grain size.

For comparison, Polydisersed Emulsion B was prepared in the following procedure.

An aqueous gelatin solution containing 0.3 mol of potassium bromide and 0.036 mol of potassium iodide was put into a reaction vessel and to the solution were simultaneously added an aqueous solution containing 1.3 mols of silver nitrate and an aqueous solution containing 1.1 mols of potassium bromide and 0.042 mol of potassium iodide over a period of 40 minutes. The emulsion thus-prepared had size distribution in which 85% of the total grains present were within the range of ±40% of the mean grain size.

Monodispersed Emulsion A and Polydispersed Emulsion B were subjected to after-ripening to the optimum point in the conventional manner.

These emlusions were used in the seventh layer and Samples 101 to 103 were prepared in the following manner. On a cellulose triacetate film support were coated layers having the compositions set forth below to prepare a multilayer color photographic light-sensitive material.

First Layer: Antihalation layer
- A gelatin layer containing black colloidal silver Second Layer: Intermediate Layer
- A gelatin layer containing a dispersion of 2,5-di-tert-octylhydroquinone Third Layer: First Red-Sensitive Emulsion Layer
- A silver iodobromide emulsion (iodide content: 5 mol%) silver coated amount: 1.79 g/m$^2$
- Sensitizing Dye I: $6\times10^{-5}$ mol per mol of silver
- Sensitizing Dye II: $1.5\times10^{-5}$ mol per mol of silver
- Coupler A: 0.04 mol per mol of silver
- Coupler C: 0.003 mol per mol of silver
- Coupler D: 0.0006 mol per mol of silver Fourth Layer: Second Red-Sensitive Emulsion Layer
- A silver iodobromide emulsion (iodide content: 4 mol%)
- silver coated amount: 1.4 g/m$^2$
- Sensitizing Dye I: $3\times10^{-5}$ mol per mol of silver
- Sensitizing Dye II: $1.2\times10^{-5}$ mol per mol of silver
- Coupler E: 0.02 mol per mol of silver
- Coupler C: 0.0016 mol per mol of silver Fifth Layer: Intermediate Layer
- Same as the Second Layer Sixth Layer: First Green-Sensitive Emulsion Layer
A silver iodobromide emulsion (iodide content: 4 mol%)
silver coated amount: 1.5 g/m$^2$
Sensitizing Dye III: $3\times10^{-5}$ mol per mol of silver
Sensitizing Dye IV: $1\times10^{-5}$ mol per mol of silver
Coupler B: 0.05 mol per mol of silver
Coupler M: 0.008 mol per mol of silver
Coupler D: 0.0015 mol per mol of silver Seventh Layer: Second Green-Sensitive Emulsion Layer
Polydispersed silver iodobromide emulsion B prepared as described above (iodide content: 6 mol%)
silver coated amount: 1.6 g/m$^2$
Sensitizing Dye III: $2.5\times10^{-5}$ mol per mol of silver
Sensitizing Dye IV: $0.8\times10^{-5}$ mol per mol of silver
Coupler B: 0.02 mol per mol of silver
Coupler M: 0.003 mol per mol of silver
Coupler D: 0.0003 mol per mol of silver Eighth Layer: Yellow Filter Layer
A gelatin layer containing yellow colloidal silver and a dispersion of 2,5-di-tert-octylhydroquinone Ninth Layer: First Blue-Sensitive Emulsion Layer
A silver iodobromde emulsion (iodide content: 6 mol%)

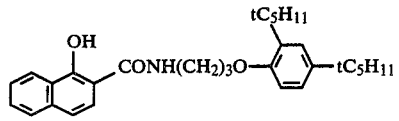

Coupler A

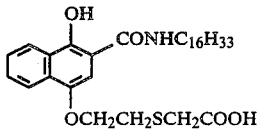

Coupler E

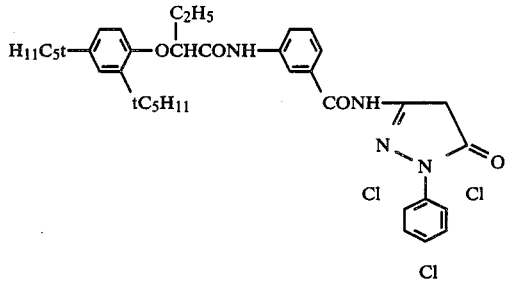

Coupler B

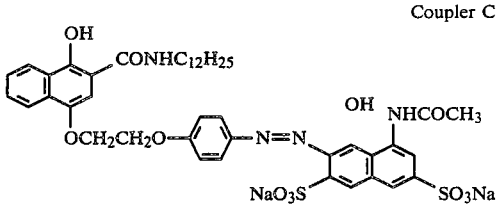

Coupler C

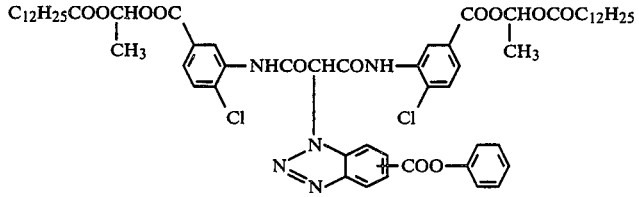

Coupler D

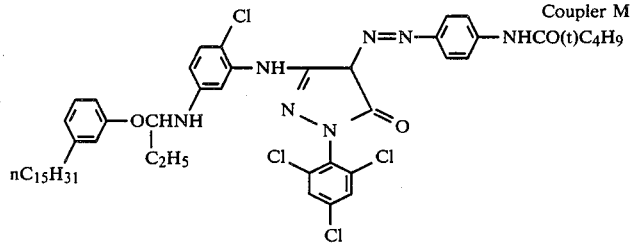

Coupler M

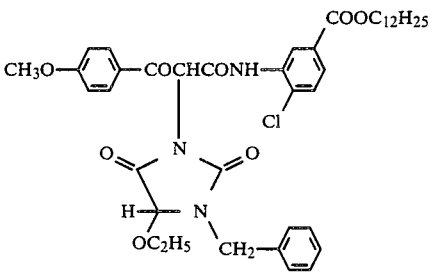

Coupler Y silver coated amount: 1.5 g/m$^2$
Coupler Y: 0.25 mol per mol of silver Tenth Layer: Second Blue-Sensitive Emulsion Layer
A silver iodobromide emulsion (iodide content: 6 mol%)
silver coated amount: 1.1 g/m$^2$
Coupler Y: 0.06 mol per mol of silver Eleventh Layer: Protective Layer
A gelatin layer containing polymethyl methacrylate particles (having a diameter of about 1.5 microns)

A gelatin hardener and a surface active agent were incorporated into each of the layers in addition to the above described components.

The sample thus prepared was designated Sample 101.

The compounds used for preparing the sample are as follows:

Sensitizing Dye I: Pyridinium salt of anhydro-5,5'-dichloro-3,3'-di-(γsulfopropyl)-9-ethylthiacarbocyanine hydroxide Sensitizing Dye II: Triethylamine salt of anhydro-9-ethyl-3,3'-di-(γsulfopropyl)-4,5,4',5'-dibenzothiacarbocyanine hydroxide Sensitizing Dye III: Sodium salt of anhydro-9-ethyl-5,5'-dichloro-3,3'-di-(γsulfopropyl)oxacarbocyanine Sensitizing Dye IV: Sodium salt of anhydro-5,6,5',6'-tetrachloro-1,1'-diethyl-3,3'-di-{β-[β-(γ-sulfopropoxy)ethoxy]ethyl}imidazolocarbocyanine hydroxide Sample 102: The sample was prepared in the same procedure as described in Sample 101 except that an equimolar amount of Coupler M-3 was added in place of Coupler B.

Sample 103: The sample was prepared in the same procedure as described in Sample 102 except that Monodispersed Emulsion A was used in the seventh Layer.

When Samples 101 to 103 thus prepared were wedge-exposed to white light, they showed almost the same sensitivity and same gradation.

The development processing used in this case was as follows and each process was performed at 38° C.

1. Color development—3 min. 15 sec.
2. Bleaching—6 min. 30 sec.
3. Water washing—3 min. 15 sec.
4. Fixing—6 min. 30 sec.
5. Water washing—3 min. 15 sec.
6. Stabilizing—3 min. 15 sec.

The compositions of the processing solutions used in the foregoing process were as follows.

Color developing solution:
- Sodium nitrilotriacetate—1.0 g
- Sodium sulfite—4.0 g
- Sodium carbonate—30.0 g
- Potassium bromide—1.4 g
- Hydroxylamine sulfate—2.4 g
- 4-(N-Ethyl-N-β-hydroxyethylamino)-2-methylaniline sulfate—4.5 g
- Water to make—1 liter Bleaching solution:
- Ammonium bromide—160.0 g
- Aqueous ammonia (28%)—25.0 ml
- Sodium ethylenediaminetetra-acetate iron salt—130.0 g
- Glacial acetic acid—14.0 ml
- Water to make—1 liter Fixing solution:
- Sodium tetrapolyphosphate—2.0 g
- Sodium sulfite—4.0 g
- Ammonium thiosulfate (70%)—175.0 ml
- Sodium hydrogensulfite—4.6 g
- Water to make—1 liter Stabilizing solution:
- Formalin—8.0 ml
- Water to make—1 liter The granularity of the magenta color image of each of these samples was evaluated by the conventional RMS method. The evaluation of granularity by the RMS method is well known to one skilled in the art and described in, for example, *The Theory of the Photographic Process*, 4th Edition, page 619. The size of the measuring aperture was 10μ.

Also, a 110 size film was prepared from each of Samples 101 to 103 in order to be subjected to a practical photographing test. The photographed image was then printed in cabinet size, and a mental evaluation of the graininess was performed.

Furthermore, the Wiener spectrum (measuring aperture was 10μ) was measured on the granularity of the magenta color image of each of Samples 101 to 103.

The RMS granularity and the mental evaluation results thus obtained are summarized in Table 1 below.

TABLE 1

| Sample | RMS value of Magenta Image D = Dmin + 0.2 | D = Dmin + 0.7 | Mental Evaluation |
|---|---|---|---|
| Sample 101 (comparison) | 0.050 | 0.039 | The granularity was seen. |
| Sample 102 (comparison) | 0.044 | 0.037 | The granularity was comparatively good but large mottles having a tinge of magenta were seen and the granularity was rather badly seen depending on the density. |
| Sample 103 (Present invention) | 0.039 | 0.036 | Neither mottle nor granularity was seen. |

The results shown in Table 1 above indicate that Sample 102 using the dye diffusible type coupler has an improved granularity in the RMS granularity in comparison with that of Sample 101 but in Sample 102, masses of dyes are seen at a high density area, which deteriorate the visual sensation of the graininess.

This can be explained by the Wiener spectrum shown in FIG. 1 of the accompanying drawings.

That is, FIG. 1 shows that the Wiener spectrum of Sample 102 using the dye diffusible type coupler is disposed at a higher position than that of Sample 101 at a lower frequency region than 5 cycles/mm, which shows overlapping of dyes in Sample 102. On the other hand, in Sample 103 using the dye diffusible type coupler together with the monodispersed emulsion according to the present invention, the Wiener spectrum thereof is disposed at a lower position than that of Sample 101 in the whole region, which coincides with the good mental sensation of the graininess.

EXAMPLE 2

Sample 202 was prepared in the same procedure as described in Sample 101 except that Coupler C-2 was used in place of Coupler E and Polydispersed Emulsion B was used in place of the emulsion used in the fourth layer. Also, Sample 203 was prepared in the same procedure as described in Sample 202 except that Monodispersed Emulsion A was used in place of Polydispersed Emulsion B in the fourth layer.

Each of Samples 101 and Samples 202 to 203 was processed as described in Example 1, the RMS granularity and the Wiener spectrum of each sample thus processed were measured, and also the mental evaluation of the graininess of each sample was performed. The results thus obtained are shown in Table 2 below.

TABLE 2

| | Cyan Coupler* | Emulsion* | RMS Value of Cyan Image D = Dmin + 0.2 | D = Dmin + 0.7 | Mental Evaluation |
|---|---|---|---|---|---|
| Sample 101 (comparison) | Coupler E | Polydispersed Emulsion | 0.061 | 0.045 | The granularity was seen. |
| Sample 202 | Coupler C-2 | Polydispersed | 0.057 | 0.042 | Large mottles having a tinge of |

TABLE 2-continued

| | Cyan Coupler* | Emulsion* | RMS Value of Cyan Image D = Dmin + 0.2 | D = Dmin + 0.7 | Mental Evaluation |
|---|---|---|---|---|---|
| (comparison) | | Emulsion | | | cyan were seen and the granularity gave a poor visual sensation. |
| Sample 203 (present invention) | Coupler C-2 | Monodispersed Emulsion | 0.050 | 0.035 | Neither large mottle nor granularity was seen. |

*They were used for the fourth layer.

Figure 2:
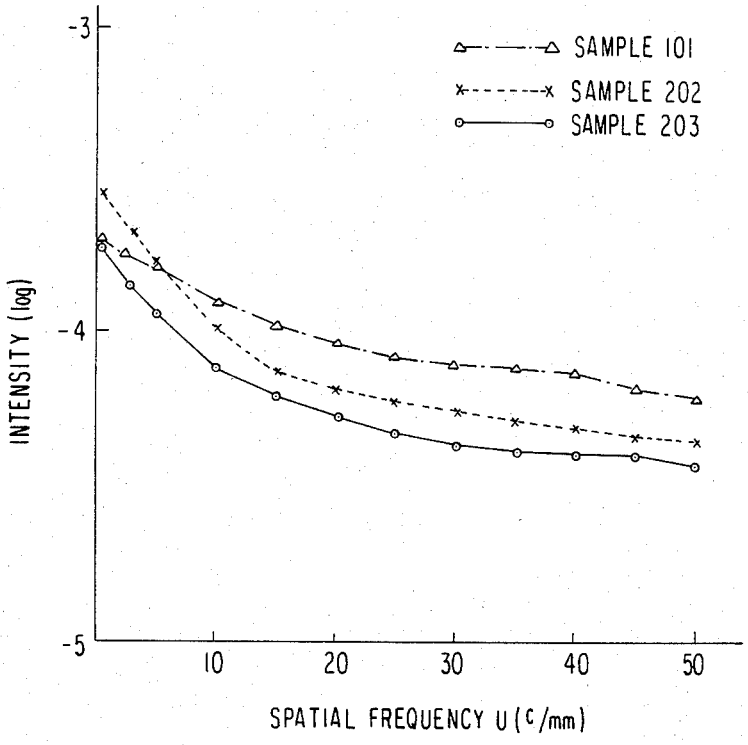
FIG. 2 is a graph showing the Wiener spectra of cyan images of samples 101, 202, and 203.

From the results shown in Table 2 above, it is apparent that in Sample 202 using the dye diffusible type cyan coupler, the RMS granularity may be small but large mottles formed rather reduce the visual sensation of the graininess thereof. This evaluation coincides with that in the Wiener spectrum of FIG. 2, the spectrum of Sample 202 is above that of Sample 101 at a lower frequency region than 5 cycles/mm. On the other hand, in Sample 203 using the dye diffusible type cyan coupler together with the monodispersed emulsion, the Wiener spectrum of Sample 203 is below those of samples 101 and 202 at the whole frequency region, which coincides with the mental evaluation shown in Table 2 above.

While the invention has been described in detail and with reference to specific embodiment thereof, it will be apparent to one skilled in the art that various changes and modifications can be made therein without departing from the spirit and scope thereof.

What is claimed is:

1. A silver halide color photographic light-sensitive material exhibiting improved RMS granularity and an improved visual sensation of graininess comprising a support having thereon a blue-sensitive silver halide emulsion layer, a green-sensitive silver halide emulsion layer and a red-sensitive silver halide emulsion layer at least one of these silver halide emulsion layers containing a non-diffusible coupler which forms a properly smearing diffusible dye upon reaction with the oxidation product of a color developing agent together with a monodispersed silver halide emulsion having an average grain size of from 0.1 micron to 3 microns and wherein the monodispersed silver halide emulsion is a silver iodobromide emulsion containing 2% by mole or more of silver iodide.

2. A silver halide color photographic light-sensitive material as claimed in claim 1, wherein the non-diffusible coupler is represented by the following general formula (1):

$$(Cp—X_a \qquad (1)$$

wherein Cp represents a diffusible coupler moiety; X represents a group which is bonded to a coupling position of the coupler moiety and is released by reaction with the oxidation product of a color developing agent, the group being a moiety including a ballast group having from 8 to 32 carbon atoms; and a represents 1 or 2.

3. A silver halide color photographic light-sensitive material as claimed in claim 1, wherein the non-diffusible coupler is present in an amount in the range of 0.005 mole to 0.2 mole per mole of silver.

4. A silver halide color photographic light-sensitive material as claimed in claim 1, wherein the non-diffusible coupler is present in an amount in the range of 0.01 mole to 0.05 mole per mole of silver.

5. A silver halide color photographic light-sensitive material as claimed in claim 2, wherein the non-diffusible coupler is represented by the following general formula (I) or (II):

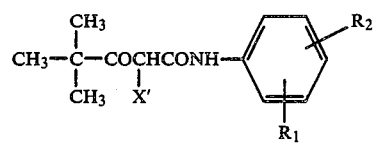

(I)

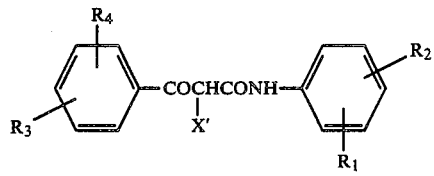

(II)

wherein $R_1$, $R_2$, $R_3$ and $R_4$, which may be the same or different, each represents a hydrogen atom, a halogen atom, an alkyl group, an alkoxy group, an aryloxy group, an acylamino group, a sulfonamido group, a carbamoyl group, a sulfamoyl group, an alkylthio group, an alkylsulfonyl group, an alkoxycarbonyl group, a ureido group, a cyano group, a carboxy group, a hydroxy group or a sulfo group, wherein the total number of the carbon atoms included in $R_1$ to $R_4$ is 10 or less; and X' represents a group having a ballast group containing from 8 to 32 carbon atoms which can be released by coupling with the oxidation product of an aromatic primary amine color developing agent.

6. A silver halide color photographic light-sensitive material as claimed in claim 5, wherein X' represents a group represented by the following general formula (III) or (IV):

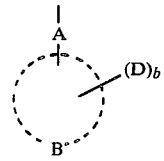

(III)

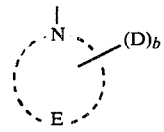

(IV)

wherein A represents an oxygen atom or a sulfur atom; B represents a non-metallic atomic group necessary for forming an aryl ring or a heterocyclic ring; E represents a non-metallic atomic group necessary for forming a 5-membered or 6-membered heterocyclic ring together with the nitrogen atom, provided that each of these rings may be further fused with an aryl ring or a heterocyclic ring; D represents a ballast group; and b represents a positive integer, provided that when b is the plural number, Ds' may be the same or different and the total number of the carbon atoms included therein is from 8 to 32, and further that D may have a bonding group selected from —O, —S—, —COO—, —CONH—, —$SO_2$NH—, —NHCONH—, —$SO_2$—, —CO—, and —NH—.

7. A silver halide color photographic light-sensitive material as claimed in claim 5, wherein the non-diffusible coupler is represented by the following general formula (V), (VI), or (VII):

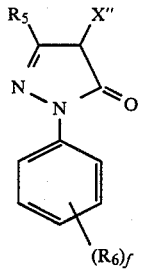
(V)

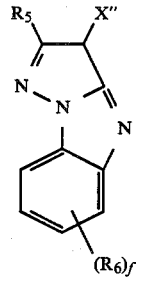
(VI)

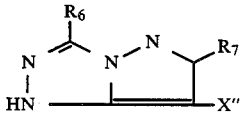
(VII)

wherein $R_5$ represents an acylamino group, a anilino group or a ureido group; $R_6$ and $R_7$ each represents a halogen atom, an alkyl group, an alkoxy group, an acylamino group, an alkoxycarbonyl group, an N-alkylcarbamoyl group, a ureido group, a cyano group, an aryl group, an N,N-dialkylsulfamoyl group, a nitro group, a hydroxy group, a carboxy group or an aryloxy group; f represents 0 or an integer of 1 to 4, provided that when f is 2 to 4, $R_6$s' may be the same or different, and further that the total number of the carbon atoms included in $R_5$ and $(R_6)_f$ in the general formula (V) or (VI) and the total number of the carbon atoms included in $R_6$ and $R_7$ in the general formula (VII) should not exceed 10; and X'' represents a group represented by the following general formula (VIII), (IX) or (X):

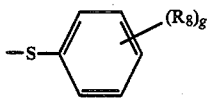
(VIII)

$$-S-R_8 \quad \text{(IX)}$$

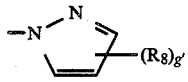
(X)

wherein g is an integer of 1 to 5; g' is an integer of 1 to 3; $R_8$ represents a substituted or unsubstituted alkyl group, a substituted or unsubstituted aralkyl group, a substituted or unsubstituted alkenyl group, or a substituted or unsubstituted cyclic alkyl group, the total number of the carbon atoms included in $(R_8)_g$ of the formula (VIII), $R_8$ of the formula (IX), or $(R_8)_{g'}$ of the formula (X) being from 8 to 32.

8. A silver halide color photographic light-sensitive material as claimed in claim 7, wherein the substituent for the substituted alkyl, aralkyl, alkenyl or cyclic alkyl group represented by $R_8$ is a halogen atom, an alkoxy group, an acylamino group, an alkoxycarbonyl group, an N-alkylcarbamoyl group, a ureido group, a cyano group, an aryl group, a nitro group, an alkylthio group, an alkylsulfinyl group, an alkylsulfone group, an anilino group, a sulfonamido group, an N-alkylsulfamoyl group, an aryloxy group, or an acyl group.

9. A silver halide color photographic light-sensitive material as claimed in claim 2, wherein the non-diffusible coupler is represented by the following general formula (XI) or (XII):

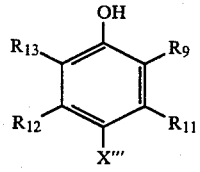
(XI)

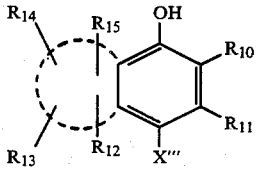
(XII)

wherein $R_9$ represents a hydrogen atom, an aliphatic group having up to 10 carbon atoms, an alkoxy group having up to 10 carbon atoms, an aryloxy group, an acylamido group represented by the following general formula (XIII), a sulfonamido group represented by the following general formula (XIV), a ureido group represented by the following general formula (XV) or a carbamoyl group represented by the following general formula (XVI):

$$-NH-CO-G \quad \text{(XIII)}$$

$$-NH-SO_2-G \quad \text{(XIV)}$$

$$-NHCONH-G \quad \text{(XV)}$$

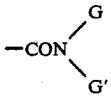
(XVI)

wherein G and G', which may be the same or different and in which the total number of the carbon atoms included in G and G' is from 1 to 12 in the formula (XVI), each represents a hydrogen atom, excluding the case that both G and G' in the formula (XVI) are a hydrogen atom, an aliphatic group having from 1 to 12 carbon atoms or an aryl group; $R_{10}$ represents a hydrogen atom, an aliphatic group having up to to 12 carbon atoms or a carbamoyl group represented by the general formula (XVI) above; $R_{11}$, $R_{12}$, $R_{13}$, $R_{14}$ and $R_{15}$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group; J represents a non-metallic atomic group necessary for forming a 5-membered or 6-membered ring; X''' represents a group having from 8 to 32 carbon atoms which is bonded to the coupling position through —O—, —S— or —N=N— and is released upon coupling with the oxidation product of an aromatic primary amine color developing agent.

10. A silver halide color photographic light-sensitive material as claimed in claim 9, wherein the alkyl group or the aryl group represented by G or G' is an alkyl group or an aryl group each substituted with a halogen atom, a nitro group, a cyano group, a hydroxy group, a carboxy group, an amino group, an alkyl group, an aryl group, an alkoxycarbonyl group, an acyloxy carbonyl group, an amido group, an imido group, a carbamoyl group, a sulfamoyl group, an alkoxy group or an aryloxy group.

11. A silver halide color photographic light-sensitive material as claimed in claim 9, wherein J represents a benzene ring.

12. A silver halide color photographic light-sensitive material as claimed in claim 9, wherein X''' represents an alkoxy group, an aryloxy group, an alkylthio group or an arylthio group each having 8 to 32 carbon atoms.

13. A silver halide color photographic light-sensitive material as claimed in claim 9, wherein the group represented by X''' contains a group capable of being dissociated with an alkali.

14. A silver halide color photographic light-sensitive material as claimed in claim 1, wherein the blue-sensitive silver halide emulsion layer contains a yellow-forming coupler, the green-sensitive silver halide emulsion layer contains a magenta-forming coupler and the red-sensitive silver halide emulsion layer contains a cyan forming coupler.

* * * * *